United States Patent [19]

Roeder

[11] 4,268,227

[45] May 19, 1981

[54] DOWNHOLE, HYDRAULICALLY-ACTUATED PUMP AND CAVITY HAVING CLOSED POWER FLUID FLOW

[76] Inventor: George K. Roeder, P.O. Box 4335, Odessa, Tex. 79760

[21] Appl. No.: 47,127

[22] Filed: Jun. 11, 1979

[51] Int. Cl.[3] ..... F04B 47/10

[52] U.S. Cl. ..... 417/358; 417/404

[58] Field of Search ..... 417/358, 403, 404

[56] References Cited

U.S. PATENT DOCUMENTS

| | | | |
|---|---|---|---|
| 1,543,488 | 6/1925 | Todd | 417/403 |
| 2,605,712 | 8/1952 | Davis et al. | 417/404 X |
| 2,818,022 | 12/1957 | Kangas | 417/358 X |
| 3,064,580 | 11/1962 | Calvert et al. | 417/358 X |
| 3,172,469 | 3/1965 | Coberly et al. | 417/358 X |
| 3,182,598 | 5/1965 | McArthur et al. | 417/358 |
| 3,517,741 | 6/1970 | Roeder | 417/358 X |
| 3,865,516 | 2/1975 | Roeder | 417/403 |

*Primary Examiner*—Leonard E. Smith
*Attorney, Agent, or Firm*—Marcus L. Bates

[57] ABSTRACT

A downhole, hydraulically-actuated pump of the free type which is sealingly received within a cavity in such a manner that a plurality of spaced-apart annular chambers are formed. The chambers are used in conjunction with other passageways to control flow of fluid to and from the pump and the surface of the ground. This flow system provides a closed circuit for the power fluid going to and from the engine. The power fluid to the engine end flows down the tubing string within which the pump assembly is located and to which the cavity is connected. A second conduit conducts spent power fluid from the pump assembly back uphole to the surface of the ground, thereby providing a closed circuit for the flow of power fluid to and from the pump assembly. A third conduit extends from the cavity, back up to the surface of the ground, so that produced fluid from the pump end is forced to the surface of the ground. The main body of the pump assembly includes a plurality of spaced-apart seals which cooperate with the pump cavity so that a system of passageways can be used for separating the various flow paths from one another.

12 Claims, 5 Drawing Figures

DOWNHOLE, HYDRAULICALLY-ACTUATED PUMP AND CAVITY HAVING CLOSED POWER FLUID FLOW

BACKGROUND OF THE INVENTION

In the production of hydrocarbons from a wellbore, it is sometimes advantageous to use a hydraulically-actuated pump device which can be circulated into the wellbore; and thereafter a supply of power fluid is connected to the tubing string so that the engine end of the pump device actuates the production end thereof, thereby producing fluid from a hydrocarbon-bearing formation, along with the spent power fluid from the engine.

A specially constructed cavity is usually attached to the lower end of the tubing string and receives the pump assembly therewithin in such a manner that power fluid flows from the surface of the earth, down through the tubing, to the engine end of the pump, while formation fluid flows into the production end of the pump, and produced fluid, along with spent power fluid, is conducted along another flow path to the surface of the earth.

In my previous U.S. Pat. No. 3,517,741, there is disclosed a free-type pump such as discussed above, along with a cavity therefor. In my previous U.S. Pat. No. 3,453,963, there is disclosed an engine end which has proven successful in the production of hydrocarbons from a deep well. In my previous U.S. Pat. No. 4,080,111 there is set forth a production end of the double-acting type which has proven successful in producing hydrocarbons.

It would be desirable to be able to employ a double-acting engine end along with a double-acting production end, and to arrange such a pump assembly so that it is of the free type and can therefore be circulated into and out of the borehole.

It would furthermore be desirable to provide the engine end of such a pump with a closed flow system so that filtered, high pressure power fluid is pumped from the surface of the earth, down the tubing string to the inlet at the engine end of the pump assembly, with the spent power fluid being returned along an isolated flow path and back to the surface of the earth, thereby enabling the power fluid to be maintained separate from the production fluid so that it can be recirculated. The combination of an engine end, production end, and cavity which achieves this desirable attribute is the subject of the present invention.

SUMMARY OF THE INVENTION

A downhole, hydraulically-actuated pump assembly of the free type having a double-acting engine end connected to a double-acting production end, and a cavity which is adapted to receive the pump assembly in such a manner that a plurality of spaced-apart, axially aligned, annular chambers are formed between the main body of the pump assembly and the inner cylindrical surface of the cavity. The pump assembly and cavity further include various different flow passageways and ports arranged respective to one another whereby power fluid flows from the surface of the earth down to a packer nose assembly, through a hollow production rod and piston, through a hollow engine rod and piston, and into an engine valve assembly, where power fluid is effected across alternate faces of the engine piston, thereby driving the piston in a reciprocating manner.

The engine and production pistons share a common hollow connecting rod so that reciprocation of the engine piston imparts reciprocatory motion into the production piston, thereby causing the production end to produce fluid.

Spent power fluid from the valve assembly is conducted into one of the before-recited annular chambers, through a port formed into the cavity, and into a flow conduit which extends uphole to the surface of the earth, thereby providing an isolated flow path for the power fluid system of the pump assembly.

Formation fluid is received through a standing valve device formed at the lower extremity of the cavity. The formation fluid enters the lowermost end of the pump assembly, flows through one of the before-recited annular chambers, through a passageway formed with the cavity, and to the intake valve assembly of the production end. The production piston is of the double-acting type and therefore produces fluid each stroke thereof. The production end includes upper and lower exhaust valves which exhaust from the production end, into another of the before-recited annular chambers, through a port formed within the cavity, along a passageway formed within the cavity, where the produced fluid then flows into another conduit which conducts produced fluid to the surface of the ground.

The pump assembly and cavity combination of this invention includes additional annular chambers arranged respective to one another and to other annular chambers of the system whereby the pressure generated within various ones of the annular chambers are maintained at a value which provides a minimum pressure drop across the seals which separate one annular chamber from another. Provision is also made by which the free-type pump can be retrieved from the cavity by pumping high pressure fluid down the spent power fluid return passageway.

Accordingly, a primary object of the present invention is the provision of a free-type pump assembly in combination with a cavity, together with various flow conduits and passageways, which enable the power fluid system to be maintained separate from the flow of production fluid.

Another object of the present invention is the provision of a downhole, free-type, hydraulically-actuated pump assembly in combination with a cavity therefor which enables power fluid to be flowed downhole through the production end and to the engine end, while formation fluid is conducted around the engine end to the production end, and spent power fluid is conducted along an isolated flow path back up to the surface of the ground, thereby enabling the power fluid to be recirculated.

A further object of the present invention is the provision of a downhole, free-type pump assembly having a double-acting engine end and a double-acting production end, and which includes a cavity which receives the pump assembly therewithin in such a manner to provide a plurality of spaced-apart annular chambers therebetween connected together in such a manner that the power fluid system and produced fluid are maintained isolated from one another.

A still further object of this invention is the provision of a free-type, downhole, hydraulically-actuated pump assembly having a production end located above an engine end, with power fluid flowing through the central axis of the production end, through the piston of the engine end, and to a valve assembly located below the engine end, with the produced fluid and the power fluid system being maintained isolated from one another.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
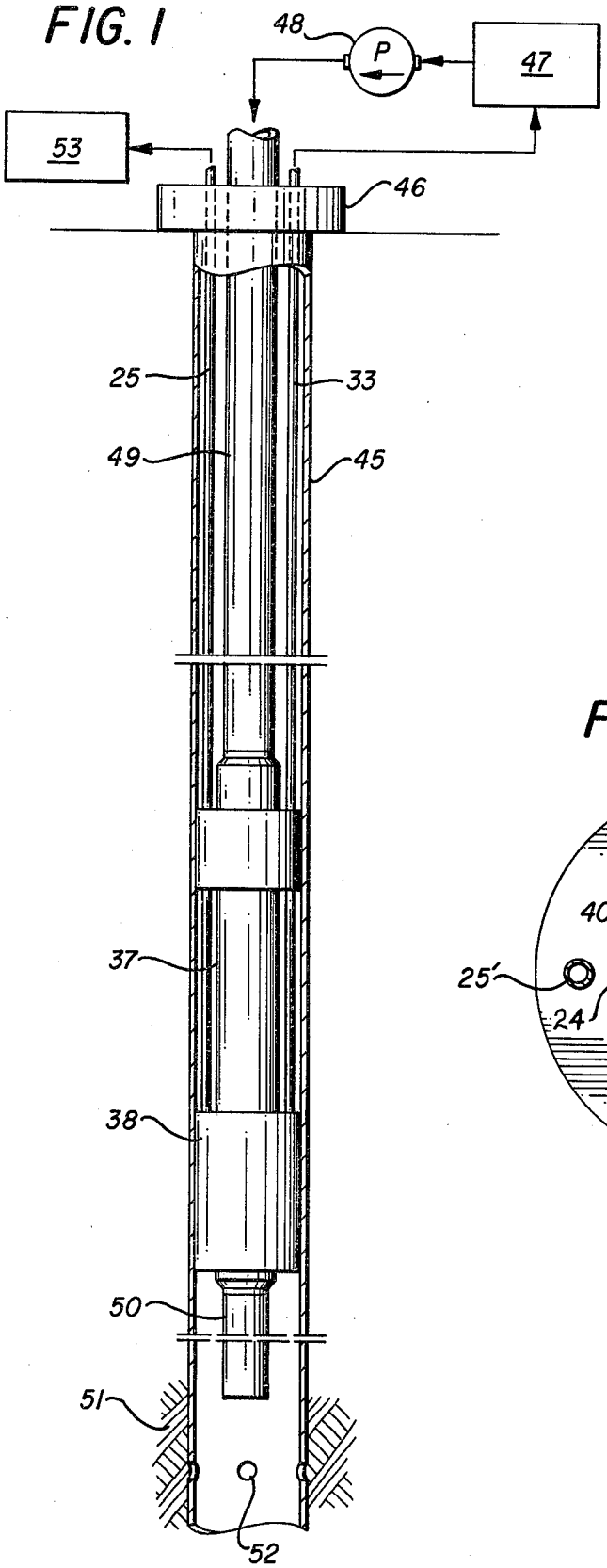
FIG. 1 sets forth a part diagrammatical, part schematical, part cross sectional representation of a borehole having a downhole pump assembly and flow system therefor arranged in accordance with the present invention.
Figures 2, 3:
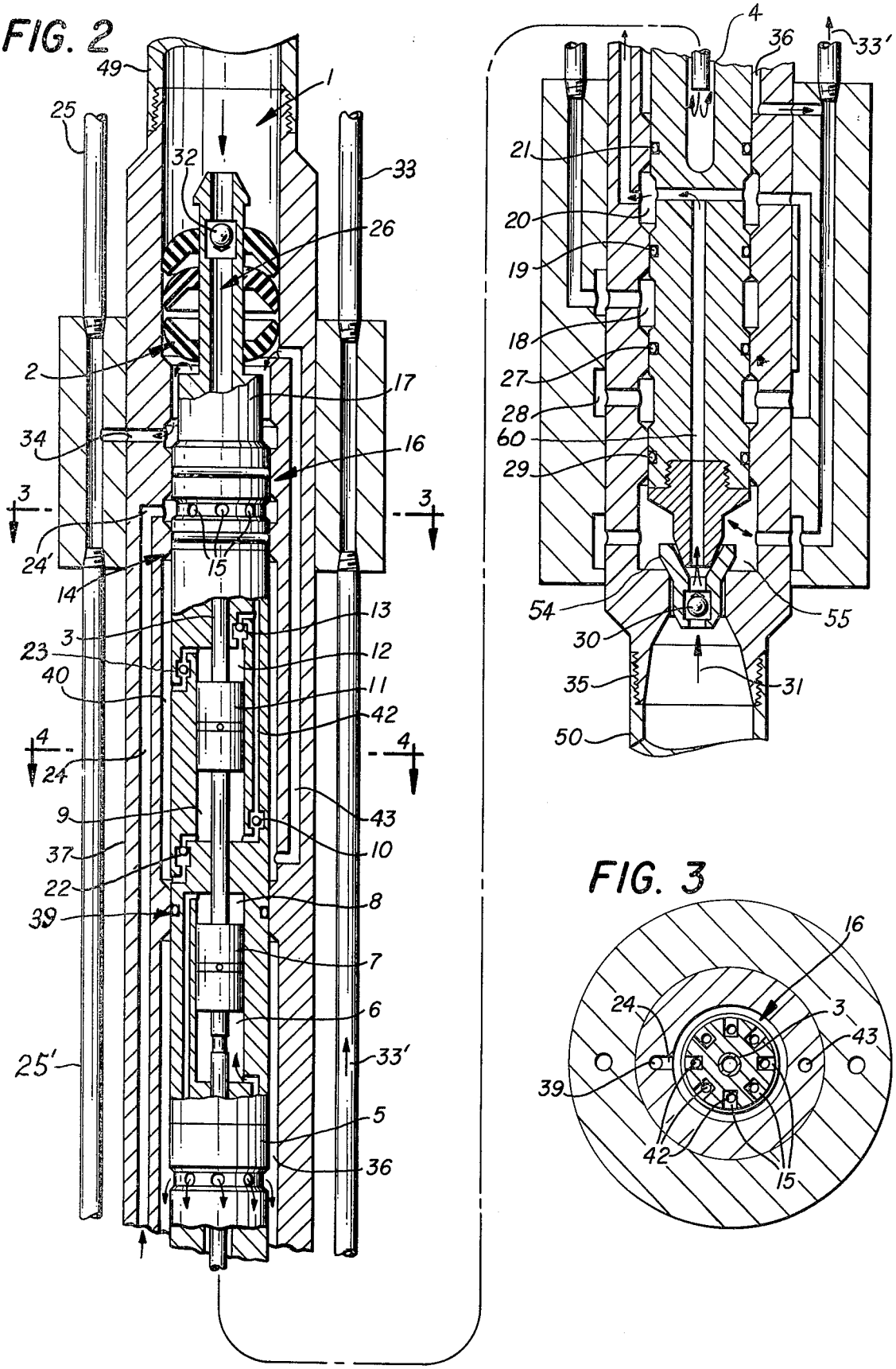
FIG. 2 is an enlarged, part cross-sectional representation of part of the apparatus disclosed in FIG. 1.
FIG. 3 is a cross-sectional view taken along line 3—3 of FIG. 2.

In FIG. 1 of the drawings there is disclosed a cased borehole 45 having a tubing string 49 located therewithin which conducts power fluid downhole, thereby making the power fluid available to the hydraulically-actuated pump assembly (seen in FIGS. 2–4) of the present invention. As seen in FIG. 2, the pump assembly includes a packer nose assembly 2 having a plurality of resilient packer elements located thereon, with the elements being arranged respective to one another whereby flow is precluded in either direction thereacross. A power oil inlet 26 makes power fluid available to the upper marginal end of the production end of the pump assembly by means of a hollow, upper balance tube 3, while the lower marginal end of the engine end thereof includes a lower, hollow balance tube at 4. A check valve 32 prevents uphole flow through the interior 26 of the packer nose assembly.

The engine end includes an engine control valve assembly 5, made in accordance with my previous U.S. Pat. No. 3,865,516, for providing a controlled flow of hydraulic fluid to and from working chambers 6 and 8 located on either side of engine piston 7.

The production end of the pump assembly is located above the engine end and includes a lower working chamber 9 connected to intake valve 10, a production piston 11 which separates an upper working chamber 12 from the before-mentioned, lower working chamber 9, and an intake valve 13 connected to working chamber 12.

Upper seal assemblies 14 and 16 underlie the packer nose assembly and form an annular chamber therebetween for providing formation fluid at suction ports 15 of the production end. The suction ports are in communication with intake valves 10 and 13 of the production end by means of the illustrated, longitudinal flow passageway 42 formed through the main body of the pump housing.

The packer nose assembly and seal assembly 16 provide an annular chamber about the upper marginal end 17 of the production end. Annular chambers 18 and 20 are separated from one another by seal assembly 19, with the chamber 18 being placed in communication with the chamber 17 by means of the flow conduit 25'. Seal assembly 21 separates annular chambers 20 and 36 from one another. The production end includes exhaust valves 22 and 23, which permit flow to occur from working chambers 9 and 12 into annular chamber 40.

Seal assembly 27 separates the annular chambers at 18 and 28 from one another, while seal assembly 29 separates the annular chambers 28 and 55 from one another. A standing valve 30 is formed within the illustrated shoe of the cavity and permits flow of formation fluid to occur at 31 towards the illustrated pump inlet. Spent power fluid flows into annular chamber 36, which is connected to flow conduit 33' and to the annular chamber 55. Connector 35 enables tail pipe 50 to be connected to the lower extremity of the pump.

The lower marginal engine end of the pump assembly includes an axial passageway 60 which communicates annular chamber 20 with formation fluid at 31. Production outlet passageway 43 is formed longitudinally through the sidewall of the cavity and interconnects annulus 40 with annulus 17.

Figure 4:
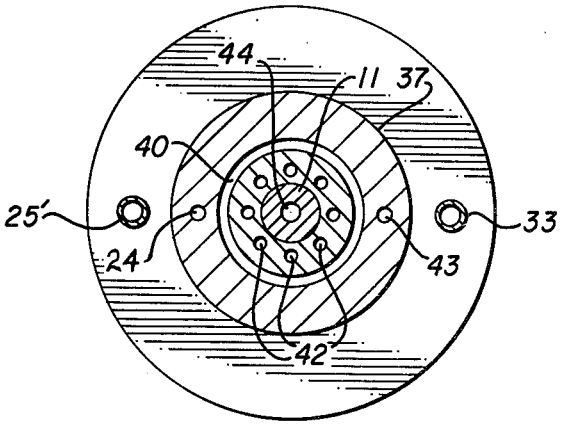
FIG. 4 is a cross-sectional view taken along line 4—4 of FIG. 2.

As seen in FIGS. 2–4, the production and engine pistons are spaced apart from one another and attached to an axially aligned connecting rod having an axial passageway 44 formed therethrough. A plurality of radial passageways 42 are employed as may be required.

As seen in FIG. 1, the cased borehole is connected to the usual Christmas tree 46. Power oil storage tank 47 is connected to a high pressure pump 48 so that power oil can flow downhole through the tubing 49 and to the cavity, which is attached to the lower end of the tubing string. Numeral 51 indicates the production formation from which formation fluid is obtained through casing perforations 52. The produced fluid is conducted uphole through conduit 25 and to storage facility 53.

The lower terminal end of the free pump assembly includes the illustrated seat which forms a sealing surface which seats against the shoe 54, thereby forming the before-mentioned chamber 55, which is interconnected with the spent power fluid return 33.

In operation, the apparatus of the present invention is assembled in the manner of FIG. 1 so that when the free-type pump assembly is placed within tubing 49, the pump apparatus can be circulated downhole by pumping fluid from 47 into the power oil tubing. The packer nose assembly 2 sealingly engages the tubing string and prevents power oil from flowing across the resilient elements of the packer device. The pump is received within the illustrated cavity in sealing relationship against the shoe 54, as set forth in my U.S. Pat. No. 3,627,048, for example.

The packer nose assembly serves as an uppermost seal. The main body of the pump is provided with spaced upper seals 16 and 14; while additional seals 39, 21, 19, 27 and 29 provide for additional axially aligned, spaced annular chambers. The shoe 54, together with the lowermost end of the pump assembly, form the lowermost annular chamber 55. Accordingly, the pump assembly and cavity cooperate together to provide a first annular chamber at 17, a second annular chamber at 15, a third annular chamber at 40, a fourth annular chamber at 36, a fifth annular chamber at 20, a sixth annular chamber at 18, a seventh annular chamber at 28, and an eighth and lowermost annular chamber at 55. The eighth and fourth annular chambers are connected together and to the spent power oil return conduit 33.

The seventh and fifth annular chambers are tied together and to the passageway 24. The sixth and first annular chambers are tied together and to the production outlet conduit 25. The third and first annular chambers are tied together and to the production conduit 25.

As power fluid flows at 1, the high pressure fluid enters the axial passageway of the packer nose assembly. The upper, hollow balance tube sealingly reciprocates within the upper marginal end of the engine end and is in fluid communication with passageway 26, so that power fluid must follow an isolated flow path from the packer nose assembly, down through the upper, hollow balance tube, in a manner similar to U.S. Pat. No. 3,517,741. Power fluid continues on through the production piston 11, through the hollow connecting rod, through the engine piston 7, and to the engine valve assembly 5, where power fluid is alternately directed into either of the chambers 6 and 8, while spent power fluid is directed into the fourth annular chamber 36. This action causes the engine end to reciprocate the production piston, while spent power fluid is conducted up the spent power fluid tubing 33 and to the storage tank 47 where the fluid can be filtered and recycled by pump 48.

As the production piston reciprocates, formation fluid from an oil-bearing formation 51 enters perforations 52 and flows into the tail pipe 50, through the one-way check valve 30, into the lowermost end or suction end of the pump assembly, where the formation fluid continues up passageway 24 into the fifth annular chamber 20. The formation fluid is also available at the seventh annular chamber 28. Formation fluid is also conducted up longitudinal passageway 24 to the second annular chamber at 15, where the formation fluid enters the main body of the production end and flows through longitudinal passageway 42 formed within the body of the pump assembly and is thereby made available to the intake or suction valves 10 and 13 of the pump assembly.

As the double-acting production end piston reciprocates, formation fluid is forced through production end exhaust valves 22 and 23, causing produced fluid to be provided at the third annular chamber 40. The produced fluid is forced up the longitudinal passageway 43 into the first annular chamber at 17 where the produced fluid then flows through ports 34, up the production conduit 25, and to the storage tank 53 located above the ground.

When it becomes necessary to retrieve the downhole pump assembly, power fluid is effected along spent power fluid flow conduit 33, thereby increasing the pressure within the eighth or lowermost annular chamber 55, to thereby unseat the pump and thereafter to force the pump assembly to flow uphole to the surface of the ground. A new pump is circulated downhole in a similar manner.

As previously noted, spent power fluid is effected at annular chambers 36 and 55, pump suction pressure at annular chambers 20, 24, and 28, and produced fluid pressure at annular chambers 17 and 18. Hence, seals 19, 29, and 39 are forced in an uphole direction, while seals 21 and 27 are forced in a downhole direction. This arrangement of pressure gradients across the various seal assemblies sets the o-ring seal against the o-ring groove and prevents leakage thereacross.

I claim:

1. A free-type, hydraulically-actuated pump assembly for use downhole in a wellbore for pumping fluid from the bottom of the borehole to the surface of the ground, comprising:

an elongated cavity located downhole in the borehole within which said free-type pump assembly is received therewithin; said cavity having an upper terminal end by which it can be connected to the lower end of a tubing string; a shoe at the bottom of the cavity;

a lower seat means formed at the lower extremity of the pump assembly by which the pump assembly is seated against said shoe, and by which formation fluid flows along an isolated flow path and into the lower intake end of the pump assembly;

a packer nose assembly at the upper extremity of the pump by which power fluid can be directed along an isolated flow path and into the upper inlet end of the pump assembly;

said pump assembly includes an engine end having a piston and a valve means, said valve means having an inlet and a spent power oil outlet; and, a production end having a double acting piston therein, a formation fluid intake, and a produced fluid outlet;

a hollow connecting rod interconnecting the piston of the engine and the piston of the production end;

means by which power oil is transferred directly from said packer nose assembly into one end of said hollow rod; said valve means being connected to receive power oil from the interior of said hollow rod, and to deliver power oil to either side of the piston of the engine;

said cavity being of a size to admit the free-type pump assembly to be circulated from the surface of the ground, downhole through the tubing string, and into seated relationship respective to the shoe;

a spent power fluid flow conduit connected to said spent power oil outlet of said valve means by which spent power fluid is returned to the surface;

a produced fluid flow conduit connected to said produced fluid outlet of said production end by which produced fluid is forced from the pump assembly uphole to the surface of the ground;

whereby power fluid flows along a closed circuit from the ground, downhole to the pump assembly to thereby actuate the engine end, while spent power fluid flows along one fluid conduit back uphole to the surface of the ground; and, produced fluid flows along another fluid conduit back uphole to the surface of the ground.

2. The pump assembly of claim 1 wherein said engine end and said production end are contained within a housing which has an outer surface spaced from the inner surface of said cavity to form an annulus therebetween;

seal means by which the annulus is divided into adjacent annular chambers; said annular chambers include upper and lower formation fluid chambers; flow conduit means forming a flow path from said seat, through a marginal lower terminal end of the pump assembly, into said lower formation fluid chamber, through a marginal medial length of the cavity to said upper formation fluid chamber where formation fluid is available to the formation fluid intake of the production end.

3. The pump assembly of claim 2 wherein said adjacent annular chambers further include upper and lower produced fluid chambers; said produced fluid flow conduit includes means forming a flow path from said produced fluid outlet, into the lower produced fluid chamber, along a marginal length of the cavity, into the upper produced fluid chamber, and into a fluid conduit which extends uphole to the surface of the ground.

4. The pump of claim 2 wherein there is included flow passageway means by which the lowermost of said annular chambers is connected to the spent power fluid return conduit so that power fluid can be effected on the lower end of the pump assembly to thereby force the pump assembly out of the cavity and uphole through the tubing string;

the uppermost of said annular chambers is formed by said packer nose assembly and one of said seal means, and includes means for conducting produced fluid to the produced fluid flow conduit leading uphole to the surface of the ground;

one of said annular chambers is positioned below said uppermost of said annular chambers and includes means connected to receive produced fluid from the production end; a passageway formed longitudinally through the side wall of the cavity and connecting together said one chamber and said uppermost chamber;

another of said annular chambers is located adjacent to said uppermost chamber for supplying formation fluid to the production end, a passageway formed through the sidewall of the cavity and interconnecting said another chamber with said formation fluid intake.

5. In a downhole, hydraulically-actuated pump assembly of the free type which can be circulated downhole through a tubing string into sealed relationship respective to a cavity, wherein the cavity is attached to the lower end of the tubing string and telescopingly receives the pump assembly therewithin, with the lower end of the pump being received in seated relationship therewith so that formation fluid is available at the suction end of the pump assembly, while power fluid is pumped down through the tubing string and into a power fluid inlet located at the upper end of the pump assembly, the combination of said pump assembly and said cavity comprising:

said pump assembly having an engine end, a valve assembly for controlling flow of power fluid to said engine end and spent power fluid therefrom; and a production end which is actuated by said engine end; said production end has a formation fluid intake and a produced fluid outlet; a packer nose seal assembly at the upper end of said pump assembly which forms a seal between the upper end of the pump assembly and the upper end of the cavity;

spaced, annular seal means located between the pump assembly and the cavity in underlying relationship respective to the packer nose assembly to provide a plurality of spaced, superimposed, annular chambers;

said annular chambers includes: an uppermost produced fluid chamber, conduit means connected to said cavity for conducting produced fluid uphole to the surface of the ground; and, an upper formation fluid supply chamber by which formation fluid is conducted directly to the formation fluid intake of the production end; and, a lower produced fluid outlet chamber by which produced fluid is conducted directly from the produced fluid outlet; a longitudinally extending passageway formed within a sidewall of the cavity and interconnecting the lower produced fluid outlet chamber with the uppermost produced fluid chamber; and, a spent power fluid annular chamber for receiving spent power fluid directly from the engine end; and, a lower formation fluid supply chamber underlying said lower produced fluid outlet chamber, a passageway formed within said pump assembly which interconnects said formation fluid supply chamber with said suction end of the pump assembly; a passageway formed within a sidewall of the cavity which interconnects the upper and lower formation fluid supply chamber together;

said production end having a double-acting piston therewithin; and, said engine end having a double-acting piston therewithin; said engine end includes an upper and lower balance tube chamber, an upper and lower balance tube reciprocatingly received within said balance tube chambers;

said valve means being connected to provide power oil to either side of the engine piston and return power oil to said spent power fluid annular chamber; an exhaust from said valve means being connected to said spent power fluid annular chamber;

a hollow piston rod connecting said engine and production pistons together, with the upper marginal end of the rod being said upper balance tube and the lower marginal end of the rod being said lower balance tube;

a flow passageway formed through said packer nose assembly, into the upper end of said rod, through said production and engine pistons, and into said lower balance tube chamber to provide said valve means with a source of power fluid;

so that power fluid flows to and from the engine along an isolated flow path, while the produced fluid flows from the borehole along another flow path.

6. The combination of claim 5, and further including a lowermost chamber formed above the shoe of the cavity and below the formation fluid intake cavity, a passageway formed through the sidewall of the cavity and interconnecting said lowermost chamber with said spent power fluid chamber;

whereby power fluid can be pumped down the spent power fluid return conduit to cause the pump assembly to be unseated and circulated uphole towards the surface of the ground.

7. The combination of claim 5 wherein said production end is located above said engine end, and said valve means is located below said engine end;

a power oil flow passageway extends from said valve means directly into the engine end to provide power oil to one side of the engine piston, while another power oil flow passageway extends from said valve means, through the main body of the engine end, to provide power oil to the other side of the piston, so that power fluid and spent power fluid is alternately effected on opposed sides of the piston to cause the engine piston to reciprocate within the engine end thereof.

8. The combination of claim 5 wherein said production end includes an intake valve means and an exhaust valve means located on either side of the production piston, said intake valve means being connected together by a passageway formed through the main body of the engine end and to said formation fluid intake chamber, said exhaust valves being connected to exhaust produced fluid directly into said lower produced fluid chamber.

9. The combination of claim 5 wherein a lowermost chamber is formed between the shoe of the cavity and below the lower formation fluid supply chamber, a passageway formed through the sidewall of the cavity and interconnecting said lowermost chamber with said spent power fluid chamber;

whereby power fluid can be pumped down the spent power fluid return conduit to cause the pump assembly to be unseated and circulated uphole towards the surface of the ground;

said production end is located above said engine end and said valve means for the engine is located below said engine end;

a power oil flow passageway extends from the last said valve means directly into the engine end to provide power oil to one side of the engine piston, while another power oil flow passageway extends from the last said valve means, through the main body of the engine end, to provide power oil to the other side of the piston, so that power fluid and spent power fluid is alternately effected on opposed sides of the piston to cause the engine piston to reciprocate within the engine end thereof.

10. The combination of claim 5 wherein said production end is located above said engine end and said valve means for the engine is located below said engine end;

a power oil flow passageway extends from the last said valve means directly into the engine end to provide power oil to one side of the engine piston, while another power oil flow passageway extends from the last said valve means, through the main body of the engine end, to provide power oil to the other side of the piston, so that power fluid and spent power fluid is alternately effected on opposed sides of the piston to cause the engine piston to reciprocate within the engine end thereof;

said production end includes an intake valve means and an exhaust valve means located on either side of the production piston, said intake valve means being connected together by a passageway formed through the main body of the engine end and to one of the recited formation fluid intake chambers, said exhaust valve means being connected to exhaust produced fluid directly into one of said produced fluid chambers.

11. The combination of claim 5, and further including a lowermost chamber formed at the shoe of the cavity, a passageway formed through the sidewall of the cavity and interconnecting said lowermost chamber with said spent power fluid chamber;

whereby power fluid can be pumped down the spent power fluid return conduit to cause the pump assembly to be unseated and circulated uphole toward the surface of the ground;

said production end is located above said engine end and said valve means for the engine is located below said engine end;

a power oil flow passageway extends from the last said valve means directly into the engine end to provide power oil to one side of the engine piston while another power oil flow passageway extends from the last said valve means, through the main body of the engine end, to provide power oil to the other side of the piston, so that power fluid and spent power fluid is alternately effected on opposed sides of the engine piston to cause the engine piston to reciprocate within the engine end thereof;

said production end includes an intake valve means and an exhaust valve means located on either side of the production piston, said intake valve means being connected together by a passageway formed through the main body of the engine end and to one of said formation fluid intake chambers, said exhaust valve being connected to exhaust produced fluid directly into one of said produced fluid chambers.

12. The combination of claim 5, and further including a lowermost chamber formed between the shoe of the cavity and the formation fluid intake cavity, a passageway formed through the sidewall of the cavity and interconnecting said lowermost chamber with said spent power fluid chamber;

whereby power fluid can be pumped down the spent power fluid return conduit to cause the pump assembly to be unseated and circulated uphole towards the surface of the ground;

said production end includes an intake valve means and an exhaust valve means located on either side of the production piston, said intake valve means being connected together by a passageway formed through the main body of the engine end and to one of said formation fluid intake chambers, said exhaust valves being connected to exhaust produced fluid directly into one of said produced fluid chambers.

* * * * *